United States Patent [19]

Sauer et al.

[11] 4,430,537

[45] Feb. 7, 1984

[54] GETTER AND ELECTRICAL SWITCHING SYSTEM USING SUCH GETTER

[75] Inventors: Hans Sauer, Fichtenstrasse 5, D-8024 Deisenhofen, Fed. Rep. of Germany; Takashi Takada, Shijonawate; Yukihiro Kondo, Hirakata, both of Japan

[73] Assignee: Hans Sauer, Deisenhofen, Fed. Rep. of Germany

[21] Appl. No.: 363,584

[22] Filed: Mar. 30, 1982

[30] Foreign Application Priority Data

Mar. 31, 1981 [JP] Japan ..... 56-48766
Jan. 8, 1982 [DE] Fed. Rep. of Germany ..... 3200392

[51] Int. Cl.[3] ..... H01H 9/04
[52] U.S. Cl. ..... 200/302.1
[58] Field of Search ..... 200/302; 156/DIG. 66; 313/481; 252/181.1, 181.2, 181.7; 357/78

[56] References Cited

U.S. PATENT DOCUMENTS 3,508,021 4/1970 Bellis ..... 200/302 X
3,829,632 8/1974 Klehm, Jr. ..... 200/302 X
4,360,444 11/1982 Esterl et al. ..... 200/302 X

FOREIGN PATENT DOCUMENTS 1243271 7/1970 Fed. Rep. of Germany .
2553568 6/1977 Fed. Rep. of Germany ... 252/181.1
2462277 7/1978 Fed. Rep. of Germany .

OTHER PUBLICATIONS

Siemens Components 19 (1981) Heft 5, Josef Weiser, "Hohe Kontaktzuverlassigkeit des Kleinrelais D1 Durch Getter", pp. 157–160.

*Primary Examiner*—John W. Shepperd
*Assistant Examiner*—Renee S. Kidorf
*Attorney, Agent, or Firm*—Schwartz, Jeffery, Schwaab, Mack, Blumenthal & Koch

[57] ABSTRACT

A getter for use in a sealed contact chamber consists of a porous getter material which acts to adsorb substances which could create resistive films on electrical contacts. By disposing such a getter within the contact chamber of a switching device, such as an electromagnetic relay, molecules of, for instance, organic compounds, may be selectively and over long terms adsorbed to the getter and thus kept away from the contacts. The selective adsorption of such molecules is achieved by a porous getter material in which the majority of the pores have diameters greater than 3 nm and smaller than 100 nm, with the mean value of pore diameter ranging from about 7 nm to about 20 nm. The getter material may be substantially $Al_2O_3$.

15 Claims, 6 Drawing Figures

GETTER AND ELECTRICAL SWITCHING SYSTEM USING SUCH GETTER

BACKGROUND OF THE INVENTION

This invention relates to a getter and an electrical switching system using such getter, wherein the getter is made of a porous getter material which has an adsorptive effect on substances which could create resistive films on electrical contacts.

The purpose of using a getter in a sealed contact chamber is to prevent molecules, e.g. of organic compounds, from forming resistive films on electrical contacts by long-termed adsorption. Although it is known in the art that the gettering effect should be selective with respect to such particular substances, previous solutions were insuccessful because it had not been recognized that a generally high gettering effect even can be harmful for electrical contacts. This is true, for example, if conventional getter materials known from vacuum technology are used. The pores of such getter materials have average diameters of no more than 2 to 4 nm and are therefore mainly only capable of adsorbing small molecules, for example those of protective gases present in the contact chamber.

In the periodical "Siemens Components" No. 19 (1981), vol. 5, page 158, there is an indication that, due to variations in the pore size as caused in production, the inner surface of an activated carbon getter can amount to as much as 2.000 $m^2/g$ which leads to the conclusion that the pores are extremely small, with an average diameter of less than 2 nm. Such a getter will cause a reduction of the pressure which, in turn, will considerably reduce the breakdown voltage of the contacts. On the other hand, if the leakage rate of the contact chamber is greater than $10^{-5}$ $cm^3$.bar/s, the getter may be saturated by gases leaking into the contact chamber before the relay or other switching device is put into operation. In this case, a gettering of molecules which create resistive films will take place to an insignificant extent only.

It is furthermore known from the same periodical that, with activated carbon getters having widely varying pore diameters, loaded with styrene vapor and produced in accordance with a special technology, a relative increase in weight of about 50% resulting in a saturation of the getter occurs already after 2.5 hours. Since it is further described that the getter has an absorptive power of $\Delta V=2$ $cm^3$ and a contact chamber having a volume $V1=0.12$ $cm^3$ was available, an apparent inner volume $V2=V1+\Delta V=2.12$ $cm^3$ was available when the getter was introduced in the contact chamber. Under these circumstances, if the contact chamber is sealed at a pressure $P1=1$ bar$=10^5$ $N/m^2$, the pressure P2 within the contact chamber at thermal pressure is reduced to about $$P2=V1/V2\cdot P1=0.12/2.12\cdot 1 \text{ bar}=56.6 \text{ mbar},$$

which causes a decrease in the breakdown voltage by more than 60%.

To avoid reduction in quality by a lowering of the pressure and also to avoid premature saturation of the getter, German patent specification No. 2 462 277 proposes an approach in which a BaOFe magnet having relatively large pores is activated as a getter, with the option of using an additional getter. This turned out to be quite useful over long terms. By using the activated magnet alone, a reduction of the resistance of the films existing on the contacts by about 10 mΩ, thus an increase in the contact reliability by a factor of about 100 was achieved. Nevertheless, foreign layers on the average order of about 10 mΩ remained. The use of an additional getter having substantially smaller pores led to further success. This, however, has the disadvantage of increased production cost and/or the restriction to polarized relays or other polarized switching devices.

German patent specification No. 1 243 271, German Auslegeschrift No. 2 646 680, and German Offenlegungschrift No. 2 931 596 propose to produce the contact chamber or a coil bobbin forming a contact chamber entirely or partly of a getter material. In one case, it was intended to bind ions generated by discharges within the contact chamber, while the other case aimed at a higher gettering effect than that achieved with known getter materials such as activated carbon. In these proposals, however, the above-mentioned disadvantageous evacuating effect is even stronger, particularly since only the gettering effect but not the adsorptive power with respect to molecules forming resistive films was taken into account. Actually, it would have been necessary to limit the gettering surface, i.e. the gettering effect, to a certain degree to prevent the pressure from being substantially reduced. This would be different in vacuum or high-vacuum contact chambers in which pressures below $10^{-1}$ mbar exist.

It is an object of the invention to provide a getter for use in a sealed contact chamber, which is capable of a long-term and selective adsorption chiefly of those molecules which have a tendency to form resistive films on the contacts, and which can be employed with relays and other switching devices without problem.

It is another object of the invention to provide an electrical switching system which includes electrical contacts and a getter disposed in a housing sealed against the environment, the getter being capable of a long-term and selective adsorption chiefly of those molecules which have a tendency to form resistive films on the contacts, and which can be employed with relays and other switching devices without problem.

SUMMARY OF THE INVENTION

The getter used in accordance with this invention consists of a porous getter material adapted to adsorb substances capable of creating resistive films on electrical contacts, wherein the majority of the pores have a diameter greater than 3 nm and smaller than 100 nm, with the pore diameter mean value ranging from about 7 nm to about 20 nm.

A contact chamber is thus achieved in which a protective gas atmosphere is substantially maintained because the activated getter material due to the size of its pores adsorbs predominantly substances, such as organic polymers, which create resistive films on the contacts, whereas the considerably smaller molecules of the protective gas are adsorbed to a negligible extent only. The getter according to this invention thus has a selective effect and, because of the low concentration of molecules to be adsorbed, the getter is saturated only upon expiry of a long useful life. A long-term gettering effect is thus achieved without any noticeable evacuation of the contact chamber which could reduce the breakdown voltage. The pore size required for the molecules to be adsorbed can be realized by a specially adapted process of manufacturing the getter material.

Further objects, advantages and preferred embodiments of the invention will become apparent from the following detailed description.

DETAILED DESCRIPTION OF PREFERRED EMBODIMENTS

Figure 1:
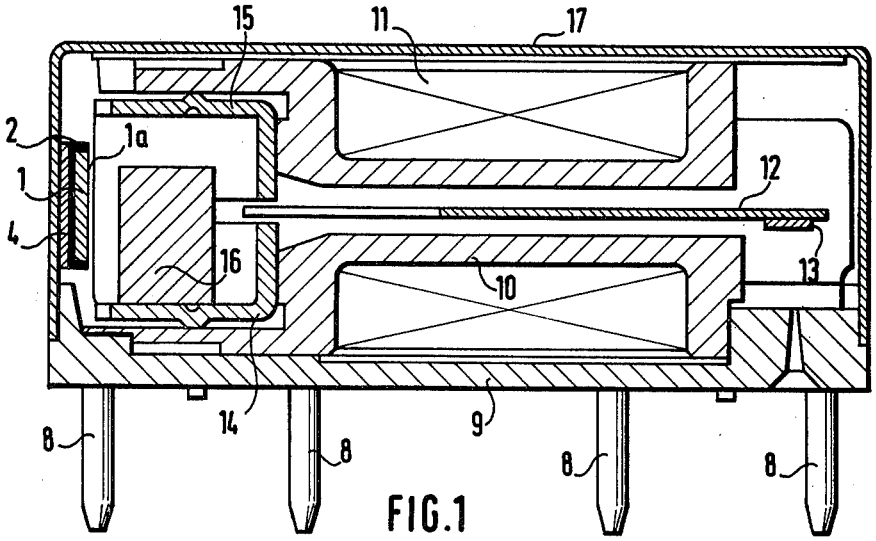
FIG. 1 is a longitudinal section of an electromagnetic relay with a getter pellet inserted.
Figure 2A:
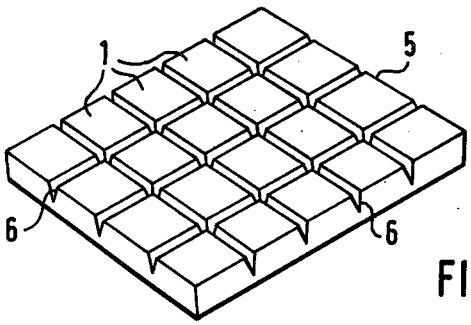
FIGS. 2(*a*) to 2(*e*) represent various stages in the production of a getter pellet.
Figure 2B:
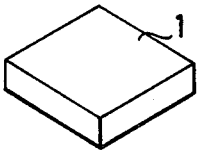
Figure 2C:
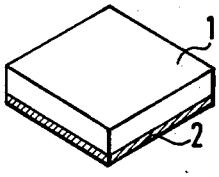
Figure 2D:
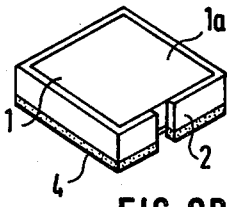
Figure 2E:
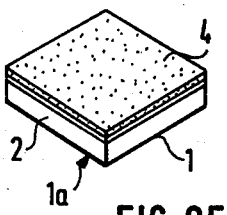

In the relay shown in FIG. 1, a bobbin 10 having a coil 11 is disposed on a base plate 9 provided with terminals 8. A contact reed 12 extends through a coaxial opening of the bobbin 10 and has one of its ends mounted on a carrier 13. The other, free end of the reed 12 is disposed between two fixed contacts 14 and 15 which also serve as pole shoes of a permanent magnet 16 disposed between the fixed contacts. The thus formed polarized relay is sealed within a metal cap 17 disposed on the base plate 9.

A getter pellet 1 is mounted by means of an adhesive 4 to the inner side of that end wall of the cap 17 which is adjacent to the free end of the reed 12 and to the fixed contacts 14 and 15. Preferably, the getter pellet 1 consists substantially of alumina ($Al_2O_3$) mixed with an organic binder and having a pore diameter which is greater than 3 nm and smaller than 100 nm with an average value ranging from about 7 nm to about 20 nm. For avoiding contamination of the getter material by the adhesive 4 or its solvent, a layer 2 of waterglass (e.g. $Na_2SiO_3$ or $K_2SiO_3$) acting as a diffusion barrier is interposed between the getter pellet 1 and the adhesive 4. As shown in FIG. 1 and, more clearly, in FIG. 2(*d*), this layer 2 may be provided also at the lateral surfaces of the getter pellet 1 so that only the surface 1*a* of the getter pellet 1 facing the contact chamber is exposed as an active surface.

Preferably, the interior of the relay which forms the contact chamber is filled with a protective gas of such a humidity that, by the influence of the getter material, a relative humidity of no less than 5% and no more than 40% is achieved. By adsorbing $H_2O$ molecules which may diffuse from the environment into the contact chamber even after the chamber has been hermetically sealed, the getter material ensures a constant humidity of the protective gas. This in turn achieves a constant breakdown voltage with respect to the contacts.

The getter material is preferably produced by sintering. The binder required for the shaping evaporates during the sintering. The intended pore size can be obtained by a proper selection of the binder, the pressure during the shaping, and the sintering temperature and time.

By fixing the getter pellet 1 to the metal cap 17, a temperature drop between the contacts and the getter material is produced in such a way that the getter material is regularly colder than the contacts. This adds to the precipitation of pollutants on the getter.

Regularly, the relay is warmer than the environment due to the energy consumption which takes place at the coil and the contacts, and the heat is dissipated via the housing. The cooling occurring at the housing reduces the temperature of the getter material which supports the gettering effect.

The size of the getter pellet is selected in view of its gettering effect and in view of the volume of the contact chamber in such a manner that no substantial decrease in pressure will occur within the contact chamber. A constant and long-term breakdown voltage is thus guaranteed in addition to the gettering effect.

To initiate the gettering effect, the getter material is preferably adapted to be activated at a temperature of at least 100° C. and at a vacuum of about $10^{-8}$ bar. Gases as well as crystalline $H_2O$ contained in the pores will thereby be released.

An economic production preferably starts from a plate 5 of getter material as shown in FIG. 2(*a*), which is provided with orthogonally intersecting grooves 6 that form breaking lines for dividing the plate into individual getter pellets one of which is shown in FIG. 2(*b*). In accordance with FIG. 2(*c*) the individual getter pellets 1 are then covered with a layer 2 of waterglass on one of their two largest surfaces, possibly also on the four lateral surfaces as shown in FIG. 2(*d*). Subsequently, the large surface of the getter pellet 1 which is covered with the waterglass layer 2 is coated with an adhesive 4 as shown in FIG. 2(*e*), which serves to fix the getter pellet to a wall or any other structural element of the contact chamber.

What is claimed is:

1. A getter for use in a sealed contact chamber, consisting of a porous getter material adapted to adsorb substances capable of creating resistive films on electrical contacts, the majority of the pores in said getter material having diameters greater than 3 nm and smaller than 100 nm, the pore diameter mean value ranging from about 7 nm to about 20 nm.

2. The getter of claim 1, wherein said getter material is substantially alumina ($Al_2O_3$).

3. The getter of claim 2, wherein said getter material is capable of being activated at a temperature of at least 100° C. and a vacuum of about $10^{-8}$ bar.

4. The getter of claim 1, wherein said getter material is shaped as a plate having orthogonally intersecting grooves defining breaking lines for dividing the plate into a plurality of individual getter pellets.

5. The getter of claim 1, wherein a pellet of said getter material is provided on one surface with a diffusion barrier and an adhesive thereon for fixing the pellet to a structural element inside said contact chamber.

6. The getter of claim 5, wherein said diffusion barrier layer consists of waterglass selected from the group including $Na_2SiO_3$ and $K_2SiO_3$.

7. An electric switching system comprising a housing sealed against the environment, electrical contacts and a getter disposed in said housing, the getter consisting of a porous material adapted to adsorb substances capable of creating resistive films on the electrical contacts, the majority of the pores in said getter material having diameters greater than 3 nm and smaller than 100 nm, the pore diameter mean value ranging from about 7 nm to about 20 nm.

8. The system of claim 7, wherein said getter material is substantially alumina ($Al_2O_3$).

9. The system of claim 8, wherein said getter material is capable of being activated at a temperature of at least 100° C. and a vacuum of about $10^{-8}$ bar.

10. The system of claim 7, wherein such a temperature gradient exists within said housing, that the getter is normally colder than said contacts.

11. The system of claim 10, wherein a portion of said sealed housing is formed by a metal cap, said pellet of getter material being fixed to an interior wall of said metal cap.

12. The system of claim 7, wherein a pellet of said getter material is provided on one surface with a diffusion barrier layer and an adhesive thereon for fixing the pellet to a structural element inside said housing.

13. The system of claim 12, wherein said diffusion barrier layer consists of waterglass selected from the group including $Na_2SiO_3$ and $K_2SiO_3$.

14. The system of claim 7, wherein said housing is filled with a protective gas of such a humidity that the action of the getter will result in a relative humidity of no less than 5% and no more than 40%.

15. The system of claim 7, wherein the volume of said getter is selected in consideration of its gettering effect and of the volume of said sealed housing so as to avoid substantial reduction of the pressure within the sealed housing.

* * * * *